US005346077A

United States Patent [19]

Randall

[11] Patent Number: 5,346,077

[45] Date of Patent: Sep. 13, 1994

[54] WIRE SHELVING AND BRACKET SYSTEM

[75] Inventor: Harold M. Randall, Fullerton, Calif.

[73] Assignee: Newell Operating Company, Freeport, Ill.

[21] Appl. No.: 856,081

[22] Filed: Mar. 18, 1992

[51] Int. Cl.[5] ..... A47F 5/08

[52] U.S. Cl. ..... 211/90; 211/153; 211/134; 248/243

[58] Field of Search ..... 211/90, 134, 153, 106, 211/187; 108/108; 248/246, 250, 243

[56] References Cited

U.S. PATENT DOCUMENTS

| | | | |
|---|---|---|---|
| 291,030 | 1/1884 | Clapper | 108/108 |
| 745,873 | 12/1903 | Mancha | 211/90 X |
| 766,605 | 8/1904 | Dilg | 108/106 |
| 1,176,588 | 3/1916 | Miller et al. . | |
| 1,677,764 | 7/1928 | Gloebler | 211/153 X |
| 2,598,130 | 5/1952 | Mallison | 248/231.7 |
| 2,924,168 | 2/1960 | Jamentz | 211/153 X |
| 2,956,766 | 10/1960 | Galassi . | |
| 3,092,047 | 6/1963 | Chesley . | |
| 3,207,100 | 9/1965 | Peacock | 108/108 |
| 3,233,852 | 2/1966 | Azar . | |
| 3,248,079 | 4/1966 | Kennedy | 211/187 X |
| 3,269,556 | 8/1966 | Streater . | |
| 3,353,684 | 10/1966 | Mastrodicasa | 248/250 X |
| 3,353,778 | 11/1967 | Sylvain et al. | 248/246 |
| 3,701,325 | 10/1972 | Fenwick . | |
| 4,098,480 | 7/1978 | Neumann | 211/153 X |
| 4,098,481 | 7/1978 | Johnson et al. | 248/243 |
| 4,533,056 | 8/1985 | Krikorian | 211/134 X |
| 4,624,376 | 11/1986 | Bertram . | |
| 4,720,069 | 1/1988 | Bessinger | 211/90 X |
| 4,783,035 | 11/1988 | Remmers . | |

FOREIGN PATENT DOCUMENTS

| | | |
|---|---|---|
| 361068 | 11/1931 | United Kingdom . |
| 365254 | 1/1932 | United Kingdom . |
| 939044 | 10/1963 | United Kingdom . |

*Primary Examiner*—David A. Scherbel
*Assistant Examiner*—Korie H. Chan
*Attorney, Agent, or Firm*—Baker & McKenzie

[57] ABSTRACT

An assembly for a wire shelf is disclosed including a novel cantilever bracket for mounting to a vertical wall support bracket. The cantilever bracket includes an inner nesting receptacle and one or more relatively positioned grooves that preclude the wire shelf from pivoting outward when excess weight is placed on the outer or front portion of the shelf. The cantilever bracket maintains the wire shelf in a safe position by restraining the inner portion of the shelf and preventing the upward pivotal movement thereof.

5 Claims, 3 Drawing Sheets

WIRE SHELVING AND BRACKET SYSTEM

This invention relates generally to wire, or ventilated, shelf assemblies, and more particularly, to a cantilever support bracket for a wire or ventilated shelf used with vertical wall supports having a column of slots for height adjustment.

BACKGROUND OF THE INVENTION

A safety problem exists when ventilated or wire-type shelves are used with standard vertical wall supports designed for home or office use. The wire shelves are not adequately anchored down by brackets designed for use with vertical wall supports; the wire shelves have a tendency to flip outward spilling the contents of the shelf and possibly causing injury.

Wire shelving systems are well known and are becoming increasingly popular. In the past, wire, or ventilated, shelves have been limited to industrial or commercial use such as in large refrigeration units, stock rooms and warehouses. The advantage of wire shelves is that they allow circulating air to reach the goods stacked on the shelves. The wire shelves designed for industrial or commercial applications are heavy-duty, free-standing structures or they may be securely bolted or attached to a wall. However, wire shelving units are not limited to industry use and are increasingly used in homes, not only for the ventilation advantages, but for aesthetic purposes as well.

There is an need for the development of a wire shelf unit compatible with standard vertical wall supports which have a column of slots for height adjustment. In these systems, two or more cantilever brackets provide support for a shelf. The brackets engage one or more slots in a vertical wall support. Because a series of slots extend from the top to the bottom of the vertical wall supports, the cantilever support brackets, and therefore the shelf itself, are height adjustable.

The aforenoted problem exists when standard cantilever support brackets are used in combination with wire shelves. If an excess amount of force or weight is applied to the front of the wire shelf, the shelf has a strong tendency to flip outward in a pivotal motion about the front edge of the shelf thereby spilling the contents of the shelf and possibly the shelf itself on the floor.

The possibility of wire shelves pivoting outward poses serious safety concerns. For one, it is common to use these shelves to store fairly heavy articles. Therefore, these heavy articles have the potential to cause serious injury to a consumer. Further, valuable items or fragile items such as glass may be stored on the shelves and may be destroyed if tipped forward onto the floor.

Therefore, an improved wire shelving system is needed to adequately secure the rear edge of the wire shelf to the bracket. While various methods for securing wire shelves to brackets are known, the known designs are fairly complicated to assemble and are therefore not ideal for home use. No known design combines the safety required with the ease of assembly demanded by modern consumers.

BRIEF DESCRIPTION OF THE INVENTION

The bracket and wire shelf of this invention are designed for use with standard, vertical wall mounting supports having a column of slots to engage the shelf supporting brackets and enable height adjustment of the brackets and shelf. The wire shelf comprises longitudinal support rods extending at a right angle to the brackets, or parallel to the wall, and transverse rods mounted to and connecting the longitudinal support rods. The bracket comprises a unitary cantilever support having an inner end directed toward the vertical wall support and an outer end directed outwardly from the wall. The inner end of the bracket includes means for attaching the bracket to the vertical wall support, such as downwardly protruding hooks, and an inner nesting receptacle for accommodating the inner support rod of the shelf. The outer end and middle portion of the bracket include grooves for accommodating outer and middle support rods.

The inner nesting receptacle includes a front wall, a bottom nesting surface for accommodating an inner support rod, a rear wall, an upper locking lip and an access opening. The upper locking lip extends outward from the top of the rear wall. The access opening extends from the outer end of the upper locking lip to the top of the front wall.

The access opening is sufficiently wide enough to allow an inner support rod to pass through, yet is narrower than the bottom nesting surface. Once the wire shelf is inserted into the bracket and the support rods have been inserted into their respective grooves, at least a portion of the inner support rod remains underneath the upper locking lip due to the relative positioning of the upper locking lip and either the outer groove or at least one middle groove.

Once the wire shelf is inserted into the bracket, the width of the grooves allow for some lateral movement of the shelf. However, as the wire shelf is moved forward, either a middle support rod or the outer support rod will engage the front wall of its respective groove before the inner support rod can move forward past the outer edge of the upper locking lip. The upper locking lip and at least one groove are all positioned relative to one another to prevent any outward pivotal movement of the inner support rod about an axis proximate to the outer support rod when an excessive load is placed on the outer end of the wire shelf.

BRIEF DESCRIPTION OF THE DRAWINGS

The invention is illustrated more or less diagrammatically in the accompanying drawings wherein.

DETAILED DESCRIPTION OF THE DRAWINGS

Figure 1:
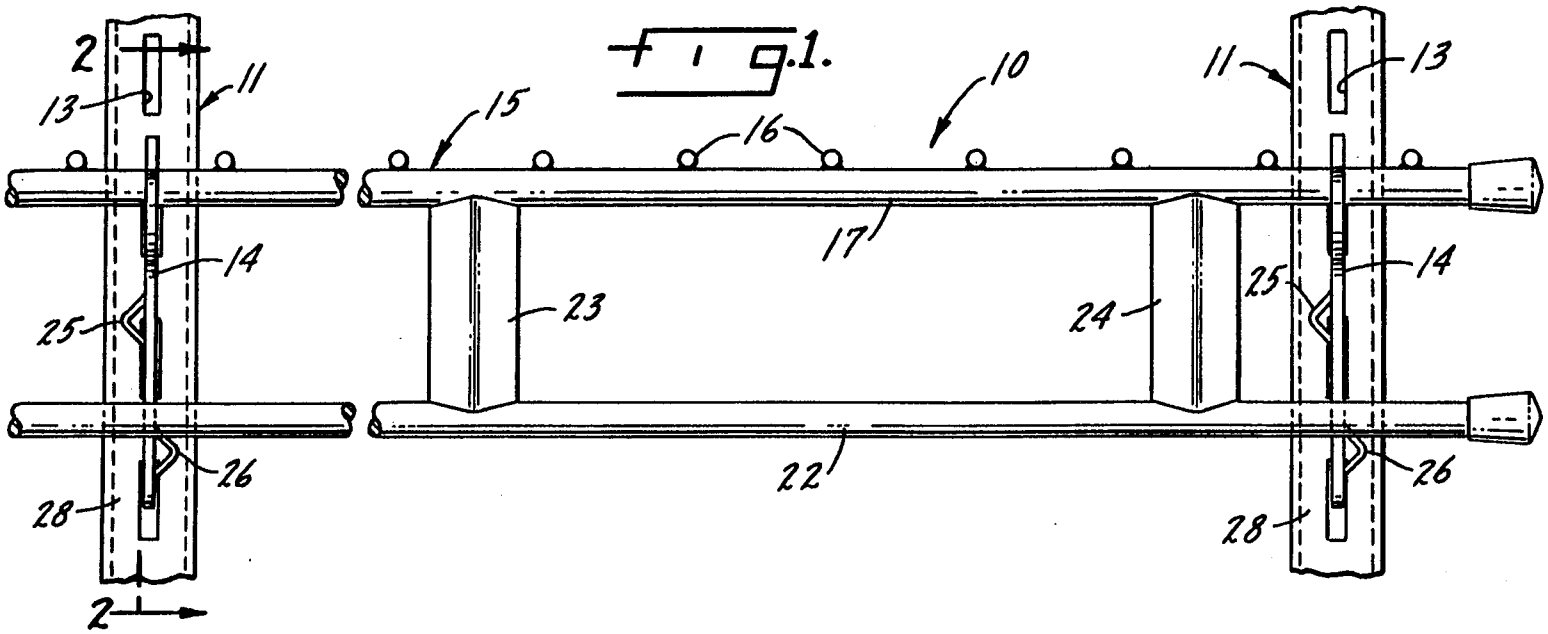
FIG. 1 is a front elevation of a shelf assembly made in accordance with this invention with parts broken away for clarity.

Like reference numerals will be used to refer to like or similar parts from Figure to Figure in the following description of the drawings.

A shelf assembly made in accordance with this invention is indicated generally at 10 in FIG. 1. The shelf assembly includes two vertical wall supports 11, each of which has a column of vertical slots 13 formed along the length thereof, a pair of support brackets 14, and a wire shelf indicated generally at 15. The planar surface defined by the wire shelf comprises a series of transverse rods 16 mounted on longitudinally extending support rods including outer support rod 17, inner support rod 18 (see FIG. 2) and, optionally, one or more middle support rods 21 (see FIG. 2). FIG. 1 also discloses an optional lower outer support rod 22 suspended from outer support rod 17 by attachment posts 23 and 24.

Another optional feature disclosed in FIG. 1 is the inclusion of outwardly extending dogs 25 and 26 at the inner end of the shelf brackets 14. Dogs 25 and 26, also shown in FIG. 2, act to increase the surface area of abutting engagement between the inner edge 27 of the bracket 14 and the outer edge of the vertical support bracket 28. Further, outwardly protruding dogs 25 and 26 increase the ability of the cantilever brackets 14 to resist forces in the longitudinal directions or, in other words, to decrease any wobbling tendency of the brackets and shelf assembly.

Figure 2:
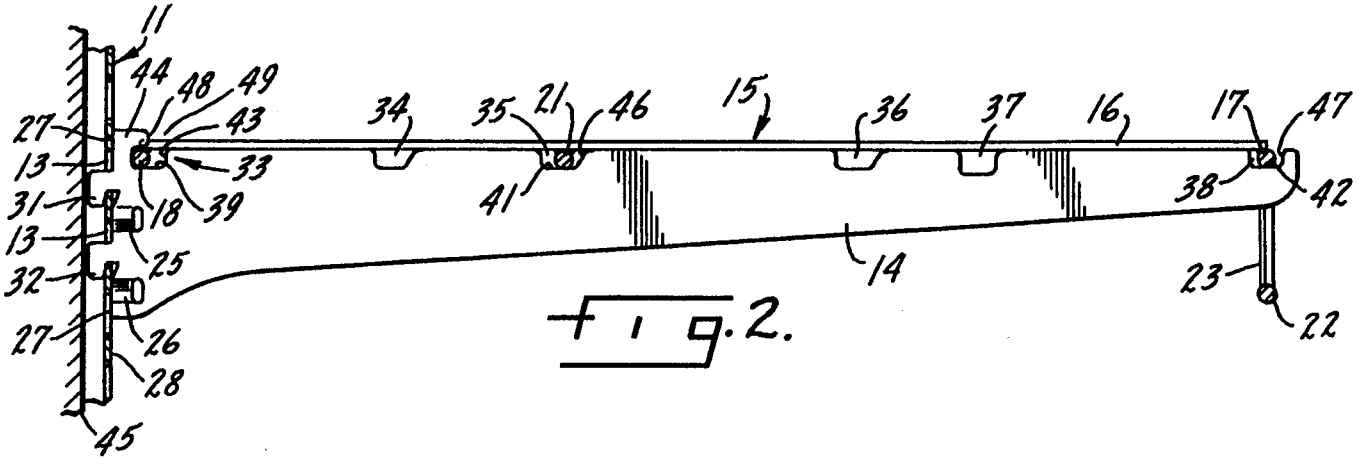
FIG. 2 is a right side section view taken substantially on line 2—2 of FIG. 1.

FIG. 2 illustrates a cantilever shelf support bracket made in accordance with the present invention. The inner end of the bracket 14 includes a means for attaching the bracket 14 to a standard vertical support post 11. The means for attachment in FIG. 2 are two downwardly protruding hooks 31 and 32. The hooks 31 and 32 are engaged by vertical slots 13 (see also FIG. 1).

The cantilever bracket 14 disclosed in FIG. 2 includes an inner nesting receptacle 33 and five grooves 34, 35, 36, 37 and 38 for accommodating longitudinal support rods. Thus, the cantilever bracket 14 can accommodate a wire shelf having anywhere from two to six longitudinal support rods. However, it will be understood that the present invention applies equally well to wire shelves having more than six support rods.

The outer groove 38 accommodates the outer support rod 17 and the middle groove 35 accommodates the middle support rod 21 of the particular wire shelf chosen for the purposes of illustration. The inner nesting receptacle 33 accommodates the inner support rod 18. The bottom nesting surface 39 of the inner nesting receptacle 33, along with the bottom nesting surfaces 41 and 42 of the middle 35 and outer 38 slots respectively, are all wider than the diameter of the support rods 17, 18 and 21. The front wall of the inner nesting receptacle 33 is indicated at 43 and an outwardly extending locking lip at 44. The employment of grooves with bottom nesting surfaces wider than the support rods enables a single bracket system to accommodate different spacing between longitudinal rods and therefore enables a single bracket system to accommodate a variety of wire shelves from the different manufactures having support rods of slightly different spacings.

However, a limit is imposed on the width of at least one nesting surface. The nesting surface of limited width may be a nesting surface 41 of any middle groove 35 or, alternatively, the nesting surface 42 of the outer groove 38. Referring to the cantilever bracket 14 of FIG. 2, when the wire shelf is moved outward away from the wall 45, either the front wall 46 of the middle groove 35 or the front wall 47 of the outer groove 38 must engage the respective support rod 21 or 17 before the inner support rod 18 either engages the front wall 43 of the inner nesting receptacle 33 or is positioned forward of the outer end 48 of the upper locking lip 44.

Once the inner support rod 18 is inserted into the inner nesting receptacle 33 (see FIG. 3), the inner support rod 18 must maintain a position where at least a portion of the inner rod 18 is below the upper locking lip 44. Otherwise, if the inner support rod 18 is positioned forward of the outer end 48 of the inner locking lip 44 and entirely below the access opening 39, the inner support rod 18 is free to pivot up and out of the inner nesting receptacle 33 as can be best visualized from FIG. 5.

To keep a portion of the inner support rod 18 below the upper locking lip 44, either a middle groove such as 35 or the outer groove 38 must be so located relative to the upper locking lip 44 such that the wire shelf is prevented from moving to a forward position that would allow the inner support rod 18 to move past the upper locking lip 44. This is accomplished by configuring the front wall 46 of the middle groove 35 or the front wall 47 of the outer groove 38 to engage its respective support rod 21 or 17, respectively, before the inner support rod 18 engages its respective front wall 43 or is entirely forward of the outer edge 48 of the upper locking lip 44.

Figure 5:
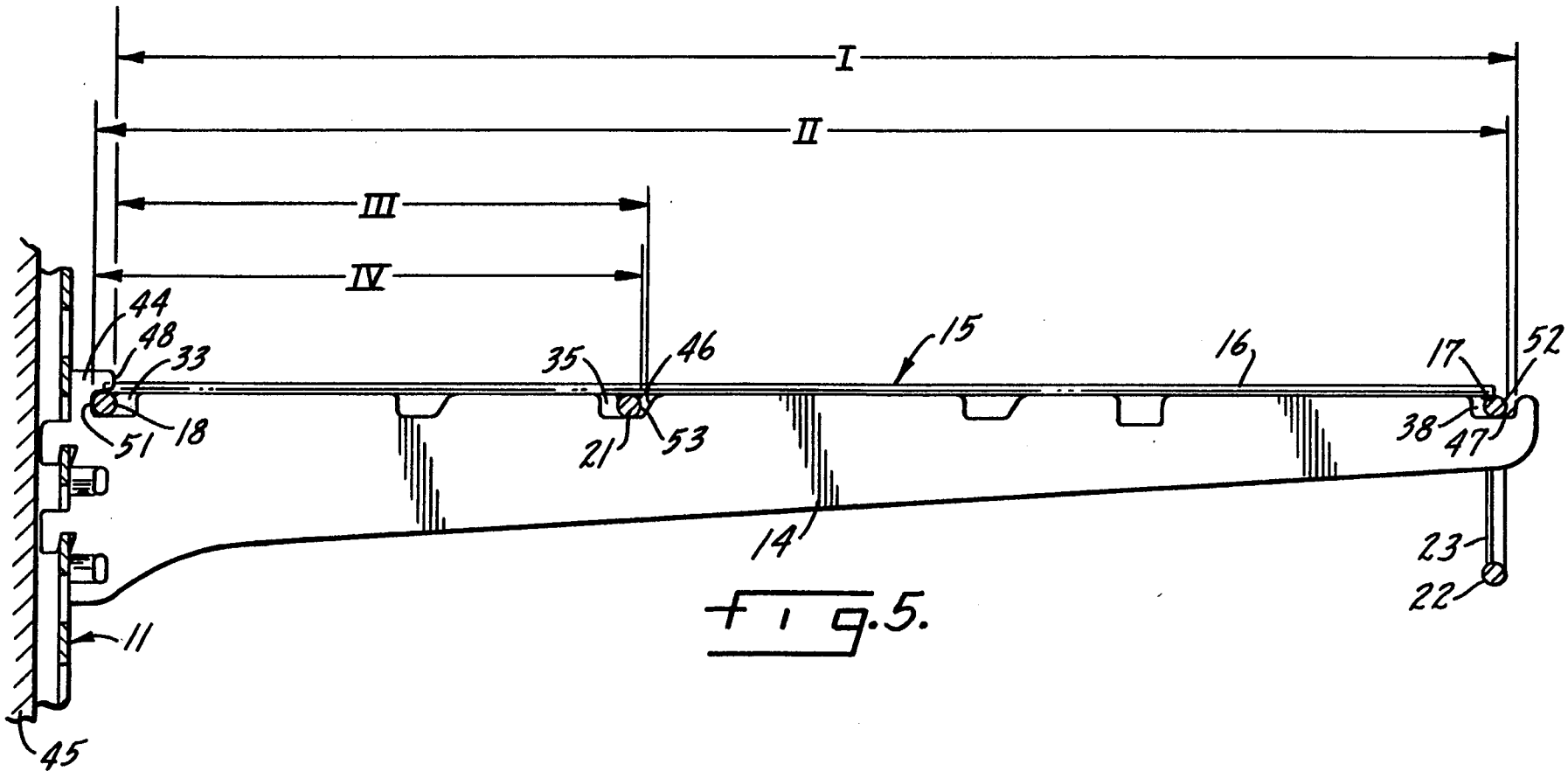
FIG. 5 is an enlargement of the right side section view shown in FIG. 2 which illustrates relative spacing relationships.

The above limitation is best understood by examining the four distances illustrated in FIG. 5. If the outer groove 38 is the groove which limits the forward movement of the shelf, then the distance between the outer edge 48 of the upper locking lip 44 and the front wall 47, indicated at I, must be less than the distance between the inner edge 51 of inner support rod 18 and the outer edge 52 of the outer support rod 17, indicated at II. If distance I is not less than distance II, the inner support rod 18 is free to move forward of the outer edge 48 of the upper locking lip 44 and therefore free to pivot up and out of inner nesting receptacle 33.

If a middle groove, such as groove 35, is the groove which limits the forward movement of the shelf, then the distance between the outer edge 48 of the upper locking lip 44 and the front wall 46 of the groove 35, indicated at III, must be less than the distance between the inner edge 51 of inner support rod 18 and the outer edge 53 of middle support rod 21, indicated at IV. If distance III is not less than distance IV, the inner support rod 18 is free to move forward of upper locking lip 44 and therefore free to pivot up and out of inner nesting receptacle 33.

Figures 3, 4:
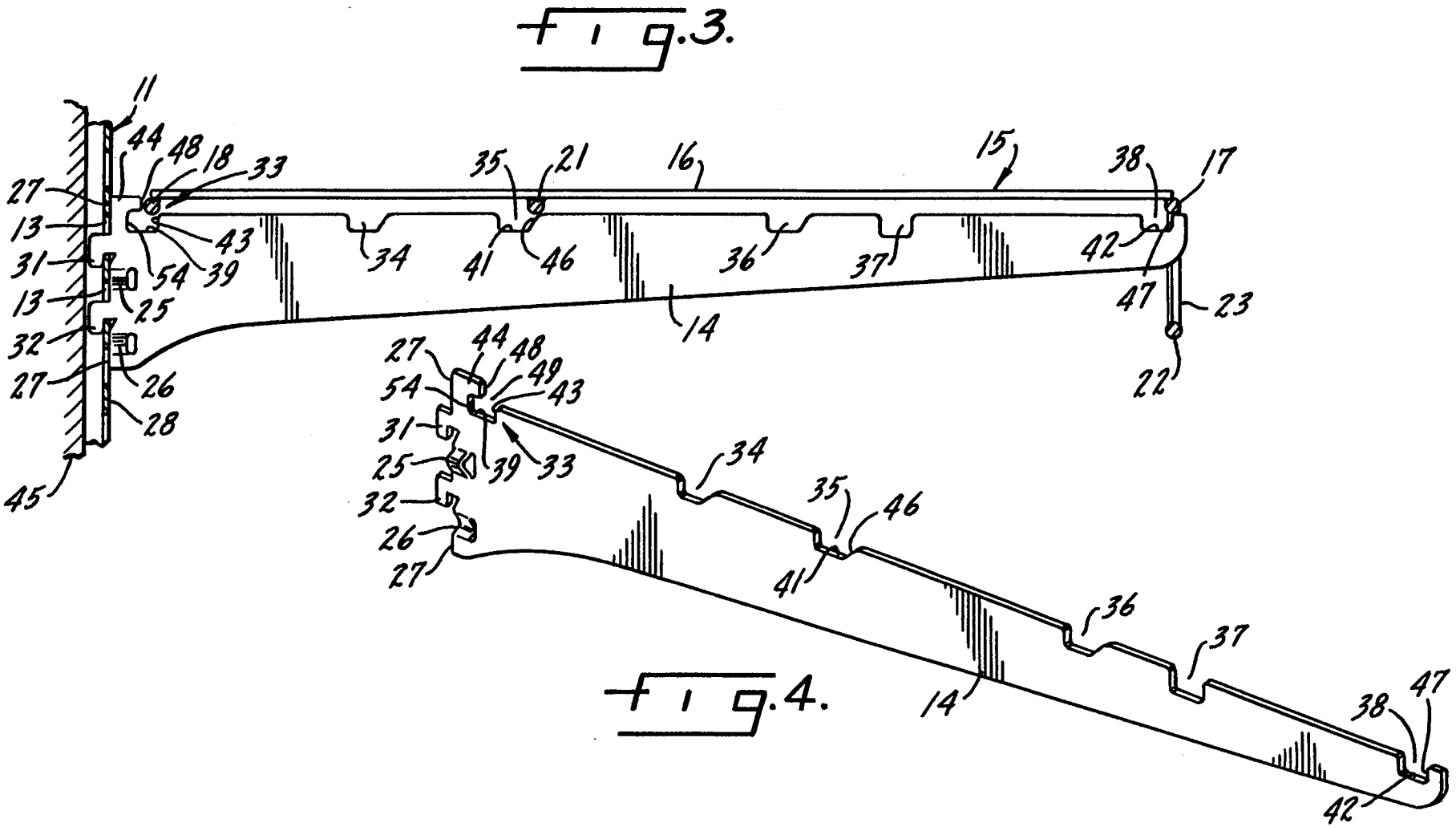
FIG. 3 is yet another right side section view showing the insertion of the shelf into the bracket.
FIG. 4 is a perspective view of the bracket.

The inner nesting receptacle 33 is best seen in FIG. 4. The nesting surface 39 extends between the front wall 43 and rear wall 54. The upper locking lip 44 extends outward from the top of the rear wall 54. The access opening 49 extends from the top of the front wall 43 to the outer edge 48 of the upper locking lip 44. The access opening 49 is wide enough to accommodate an inner support rod 18, yet is narrower than the bottom nesting surface 39. With the illustrated construction, the upper locking lip 44 serves to prevent any upward pivotal movement of inner support rod 18 when excess downward force is placed upon the front end of wire shelf 10 and more particularly, the outer support rod 17.

Generally, in wire shelving systems of this type, when excess downward force or weight is placed on the outer end of the wire shelf, the shelf has a tendency to pivot or flip outward about an axis proximate to outer support rod 17. As stated above, this can be quite dangerous. But as shown in the drawings, the present invention overcomes this problem by containing the inner support rod 18 in the inner nesting receptacle 33 via the upper locking lip 44, the narrow access opening 49, and by limiting the width of at least one middle groove 35 or the outer groove 38.

FIG. 3 illustrates yet another advantage of the present invention, namely the ease of assembly for the consumer. The cantilever bracket 14 is mounted on the vertical wall supports 11 by inserting the downwardly protruding hooks 31 and 32 into two vertical slots 13. The wire shelf is inserted into the bracket by inserting the inner support rod 18 into the inner nesting receptacle 33 and then sliding the inner support rod 18 back towards the rear wall 54. Finally, the outer end of the wire shelf is lowered and the outer rod 17 is received by the outer groove 38 and the middle rod 21 is received by the middle groove 35.

Although a preferred embodiment of the invention has been illustrated and described, it will be at once be apparent to those skilled in the art that variations may be made within the spirit and scope of the invention. Accordingly, it is intended that the scope of the invention be limited solely by the scope of the hereafter appended claims and not by the specific wording in the foregoing description.

We claim:

1. A ventilated shelf assembly, said ventilated shelf assembly including a bracket and a ventilated shelf adapted to be supported on the bracket, said ventilated shelf having a first longitudinal member located at the inner edge portion of the shelf which is structurally connected to transverse member means which extends outwardly from the first longitudinal member and a second longitudinal member which is also structurally connected to the transverse member means but located outwardly from the first longitudinal member, the first longitudinal member including an innermost surface, the second longitudinal member including an outermost surface, said longitudinal members and transverse members means forming an integral, substantially rigid, one piece ventilated shelf, said bracket having support engaging means at its inner end adapted to engage with a supporting structure, said bracket further having a nesting recess formed therein at its inner end portion for receiving the first longitudinal member, said nesting recess having a bottom surface on which said first longitudinal member rests, an inner generally vertical surface having a height no less than the vertical dimension of the first longitudinal member, an outer generally vertical surface and an upper surface which extends from the inner generally vertical surface outwardly so as to partially overlie the bottom surface, the outer generally vertical surface of said nesting recess being located outwardly from the outer end of the upper surface a distance sufficient to form an opening of a width sufficient to receive the first longitudinal member, the bracket also including an outer recess with an outermost vertical surface, the longitudinal distance between (a) the outermost surface of the outer recess in the bracket and the outer end of the upper surface of the nesting recess being less than (b) the distance between the outermost surface of the second longitudinal member and the innermost surface of the first longitudinal member whereby the shelf can only be assembled to the bracket by inserting the first longitudinal member in the nesting recess from a position in which the outer end of the shelf is elevated above the bracket, and the shelf moved toward the inner end of the bracket until the upper surface of the nesting recess at least partially overlies the first longitudinal member.

2. A combination bracket and wire shelf assembly, the combination comprising:

a wire shelf including an inner support rod with an inner edge, an outer support rod with an outer edge and means for connecting the inner support rod to the outer support rod, a unitary cantilever support comprising, the cantilever support having an inner end directed toward a vertical wall, an outer end remote therefrom, the inner end including a means for attachment to a generally vertical wall support and a single inner nesting recess for accommodating the inner support rod, the outer end including an U-shaped outer groove for accommodating an outer support rod, the outer groove having a front wall, the single inner nesting recess including a front wall having a top and a bottom, a flat nesting surface for accommodating the inner support rod, a rear wall having a top and a bottom, an upper locking lip having an outer end, the inner nesting recess also including an access opening, the flat nesting surface extending from the bottom of the front wall to the bottom of the rear wall, the upper locking lip extending outward from the top of the rear wall and substantially parallel to the nesting surface, the access opening extending from the top of the front wall to the outer end of the upper locking lip, the access opening being sufficiently wide enough for the support rod to pass through for insertion purposes, a first distance from the outer end of the upper locking lip to the front wall of the U-shaped outer groove being less than a second distance from the inner edge of the inner support rod to the outer edge of the outer support rod.

3. The combination of claim 2, wherein the position of the inner support rod on the nesting surface is substantially fixed at a rear portion of the nesting surface substantially below the upper locking lip when the outer support rod is accommodated in the outer groove.

4. The combination of claim 3, wherein the upper locking lip blocks pivotal movement of the inner support rod about an axis proximate to the outer support rod when excessive load is placed on an outer end of the wire shelf and when the inner support rod is disposed at the rear portion of the nesting recess and the outer support rod is accommodated in the outer groove.

5. A combination bracket and wire shelf assembly, the combination comprising:

a wire shelf including an inner support rod with an inner edge, an middle support rod with an outer edge and means for connecting the inner support rod to the middle support rod, a unitary cantilever support comprising, the cantilever support having an inner end directed toward a vertical wall, an outer end remote therefrom and a middle portion, the inner end including a means for attachment to a generally vertical wall support and a single inner nesting recess for accommodating the inner support rod, the middle portion including an U-shaped middle groove for accommodating an middle support rod, the U-shaped middle groove having a front wall, the single inner nesting recess including a front wall having a top and a bottom, a flat nesting surface for accommodating the inner support rod, a rear wall having a top and a bottom, an upper locking lip having an outer end, the inner nesting recess also including an access opening, the flat nesting surface extending from the bottom of the front wall to the bottom of the rear wall, the upper locking lip extending outward from the top of the rear wall and substantially parallel to the nesting surface, the access opening extending from the top of the front wall to the outer end of the upper locking lip, the access opening being sufficiently wide enough for the support rod to pass through for insertion purposes yet narrower than the nesting surface, a first distance from the outer end of the upper locking lip to the front wall of the U-shaped middle groove being less than a second distance from the inner edge of the inner support rod to the outer edge of the middle support rod.

* * * * *